US005474698A

United States Patent [19]

Rolando et al.

[11] Patent Number: 5,474,698

[45] Date of Patent: Dec. 12, 1995

[54] UREA-BASED SOLID ALKALINE CLEANING COMPOSITION

[75] Inventors: John J. Rolando, Woodbury; Bernard J. Heile, Apple Valley; Kent R. Brittain, Eagan, all of Minn.

[73] Assignee: Ecolab Inc., St. Paul, Minn.

[21] Appl. No.: 175,714

[22] Filed: Dec. 30, 1993

[51] Int. Cl.[6] ..... C11D 17/00; C11D 3/32; C11D 7/32; C11D 7/06; C11D 7/12

[52] U.S. Cl. ..... 252/90; 252/95; 252/99; 252/102; 252/103; 252/135; 252/156; 252/174; 252/174.13; 252/174.14

[58] Field of Search ..... 252/135, 156, 252/174, DIG. 16, 134, 90, 95, 99, 102, 103, 174.13, 174.14

[56] References Cited

U.S. PATENT DOCUMENTS

| | | | |
|---|---|---|---|
| Re. 32,763 | 10/1988 | Fernholz et al. | 252/90 |
| Re. 32,818 | 1/1989 | Fernholz et al. | 252/90 |
| 2,675,356 | 4/1954 | Woodworth et al. | 252/110 |
| 2,927,900 | 3/1960 | Shiraeff | 252/152 |
| 4,265,779 | 5/1981 | Gandolfo et al. | 252/135 |
| 4,595,520 | 6/1986 | Heile et al. | 252/160 |
| 4,624,713 | 11/1986 | Morganson et al. | 134/25.2 |
| 4,680,134 | 7/1987 | Heile et al. | 252/160 |
| 4,695,284 | 9/1987 | Hight | 8/137 |
| 4,846,989 | 7/1989 | Killa | 252/99 |
| 4,861,518 | 8/1989 | Morganson et al. | 252/548 |
| 5,262,132 | 11/1993 | Bricker et al. | 422/263 |
| 5,316,688 | 5/1994 | Gladfelter et al. | 252/90 |

FOREIGN PATENT DOCUMENTS

| | | |
|---|---|---|
| 0307587 | 3/1989 | European Pat. Off. . |
| 9012081 | 10/1990 | WIPO . |

*Primary Examiner*—Paul Lieberman
*Assistant Examiner*—Lorna M. Douyon
*Attorney, Agent, or Firm*—Merchant, Gould, Smith, Edell, Welter & Schmidt

[57] ABSTRACT

The invention provides a urea based solid composition and a process for preparing a homogeneous, urea-based, solid cleaning composition. Cleaning compositions for use in warewashing and cleaning hard surfaces, rinsing, sanitizing, deodorizing, and the like, made by the method are also provided. The ingredients are charged into a heated mixing apparatus and when uniform are transferred into a mold or other packaging system for dispensing the detergent. The consistency of the composition ranges from that of a fused solid block to a malleable article.

9 Claims, No Drawings

UREA-BASED SOLID ALKALINE CLEANING COMPOSITION

FIELD OF THE INVENTION

The invention is directed to a process using a casting and or agent for manufacturing homogeneous, solid cleaning compositions including ware or hard surface cleaning compositions, pot and pan cleaners, sanitizing additives, deodorant blocks, and the like. The cleaning compositions are processed without substantial component decomposition and with improved environmental, temperature and humidity, stability.

BACKGROUND OF THE INVENTION

The development of solid cleaning compositions has revolutionized the manner in which detergent compositions are manufactured, dispensed and used. Solid block compositions offer unique advantages over the conventional liquids, granules or pellet forms of detergents, including improved handling, enhanced safety, elimination of component segregation during transportation and storage, and increased concentrations of active components within the composition. Solid block cleaning compositions, such as those disclosed in Fernholz et. al., U.S. Pat. Nos. Re 32,763, Re 32,818, and Heile et al., 4,680,134 and 4,595,520, have quickly replaced many of the conventional composition forms in commercial and institutional markets.

Urea has been used in cleaning and sanitizing compositions as a hardener and solubility modifier in organic rinse aids, as described for example in Morganson et al., U.S. Pat. No. 4,624,713. Morganson et al. teach that urea can be combined with polyalkylene oxide polymers to form solidification complexes known as inclusion compounds. Urea is known to interact or react with a polyalkylene oxide compound to form a crystalline adduct, or "inclusion compound," in which urea molecules are combine with the molecules of the polymer compound in a spiral or helical formation. To achieve this physical arrangement, the polymer compound must have a structure or stereochemistry that will allow it to fit within the spiral of the urea molecules and facilitate occlusion by or with urea. In general, urea will form inclusion compounds with long straight-chain molecules of six or more carbons but not with branched or bulky molecules. Woodworth et al., U.S. Pat. No. 2,675,356, teach detergent compositions manufactured using soaps or other synthetic organic detergents. Woodworth et al. use a urea alcohol complex to form a detergent composition suitable for use and contact with human skin. Shiraeff, U.S. Pat. No. 2,927,900, teaches solid detergent mass or cake using a normally liquid surface active polyglycol ether detergent component solidified using urea fused with the liquid polyglycol ethers. Gandolfo et al., U.S. Pat. No. 4,265,779, teach grandular detergents containing a suds suppressor composition comprising a liquid hydrocarbon, a nonionic ethoxylate and a compatibilizing agent capable of forming inclusion complexes with the ethoxylate material. The preferred agent in Gandolfo et al. is urea. Hight, U.S. Pat. No. 4,695,284, teaches materials and methods for washing fabrics in cold water comprising built detergent particles containing a nonionic detergent, saturated fatty acid, builder salts, and carriers. A variety of carriers can be used including inorganic carriers such as sodium tripolyphosphate, sodium carbonate, sodium bicarbonate, sodium or potassium chloride, preferred organic carriers include carbohydrates, film forming materials, urea, etc. Materials in Hight are apparently particulate in nature.

To manufacture a solid block urea-based composition, the urea is combined with the ingredients under melting temperatures, commonly referred to as a "molten process," to achieve a homogeneous mixture. The melt is then poured into a mold and cooled to a solid form. For example, U.S. Pat. No. 4,624,713 to Morganson et al. discloses a solid rinse aid formed from a urea occlusion composition that comprises urea and a compatible surfactant, namely a polyoxypropylene or polyoxyethylene glycol compound. The solid rinse aids are prepared by mixing the ingredients in a steam jacketed mixing vessel under melting temperatures and under pressurized steam, heating the mixture to about 220° F., cooling the mixture to about 180° F., pouring the cooled mixture into a plastic container, allowing the mixture to solidify by cooling to room temperature (about 15°–32° C.), and allowing the product to cure or harden for about 2–4 days.

The instability of urea in the presence of alkaline materials is well known. Urea is known to decompose through many intermediate stages into carbon dioxide and ammonia. The decomposition is promoted through increasing alkalinity, the presence of moisture and increasing temperature. Such instabilities have rendered the use of urea, in this art area, an undesirable option as either an active cleaning agent or as a processing or solidification aid in the manufacture of alkaline materials. While urea has found some utility in the manufacture of organic material such as rinse aids and organic detergents as discussed above, the art as a whole did not consider urea a useful alternative in the manufacture of large bulk cast solid alkaline compositions. The presence of any significant amount of an alkaline base including an alkali metal hydroxide, an alkali metal silicate, an alkali metal carbonate, triethanol amine, or other organic or inorganic amines typically resulted in the exclusion of urea as a co-ingredient.

One significant problem that has caused some problems related to the manufacture, storage and use of cast solid alkaline materials relates to the environmental stability of the cast solid. Upon exposure to the atmosphere, alkaline cast solid materials can rapidly absorb substantial proportions of humidity resulting in a softening or dissolution of at least a substantial portion of the cast solid. The absorption of water can result in a softened layer of alkaline material covering the surface of the cast solid block rendering the material difficult to handle and dispense. Further, in conditions of higher humidity or higher concentrations of alkalinity, the absorption of atmospheric humidity can result in the creation of a substantial proportion of a liquid product that can slump or flow from the surface of the cast solid creating a pool of highly caustic material. Not only is the humidity and stability of the material a problem in manufacturing and handling the material, the instability can also cause substantial problems in dispensing. The softened surface or liquid material that can flow from the surface can cause substantial and uncontrollable spikes of material during dispensing. The materials are designed to be dispensed using a spray on type dispenser. In such dispensers, a spray of water is directed onto a surface of the cast solid material. When operating correctly, the spray removes a small portion of the cast solid in the form of an aqueous concentrate which is directed to a warewashing machine. The aqueous concentrate replenishes the concentration of the cleaning agent in the use locus. When the cast solid material is interacted with atmospheric water, the softened surface or the material that flows from the surface of the cast block can introduce an uncontrolled amount of material substantially in excess of that needed to replenish the concentration of cleaning materials in the washing solution. This can result in waste of the cleaning composition, spotting and staining on dishware and other related processing problems.

Accordingly, a substantial need exists to develop methods and compositions that can use urea in the form of an alkaline cast solid material. Further, a substantial need exists in resolving problems related to the humidity instability of cast solid material in manufacture, use and dispensing.

SUMMARY OF THE INVENTION

The invention is directed to a process for preparing an alkaline homogeneous, solid cleaning composition comprising a urea hardening agent and an alkaline cleaning agent. Cleaning compositions which may be manufactured according to the invention include, for example, alkaline compositions for use in warewashing and cleaning hard surfaces, sanitizing, deodorizing, and the like.

The method of making a solid, urea-based cleaning composition according to the invention includes the steps of mixing, in a mixing system, an effective hardening amount of urea and an effective amount of an alkaline cleaning agent, optionally in a minor but effective amount of an aqueous medium, to form a substantially homogeneous mixture, (b) discharging the mixture from the mixing system into a capsule or container; and (c) allowing the mixture to harden to a solid composition. The amount of the aqueous medium in the mixture is effective to solubilize the urea, if needed, in the mixture, and to dispense and dilute the mixture as desired. The invention provides a process for manufacturing a homogeneous, urea-based cleaning composition under ambient processing temperatures of about 40° to 70° C. A minimal but effective amount of heat may be applied to the mixture from an external source to facilitate processing, for example, during the mixing phase to maintain the mixture at an effective viscosity.

The ingredients can be processed in a batch or continuous processing system capable of mixing the ingredients together at low or high shear to provide a homogenous mixture The mixing rates can be adjusted to aid in retarding solidification to maintain the mixture as a flowable mass during processing. Batch mixing can be performed in conventional tanks and vessels. Continuous mixing systems useful according to the invention include a continuous flow mixer, or more preferably a single-or twin-screw extruder, a twin-screw extruder being highly preferred.

A variety of urea-based cleaning compositions may be produced according to the present method. The types and amounts of ingredients that comprise a particular composition will vary according to its purpose and use. The composition will comprise an effective cleaning amount of a an alkaline cleaning agent, and optional other ingredients as desired. The ingredients may be in the form of a solid such as a dry particulate, or a liquid. An ingredient may be included separately or as part of a premix with another ingredient. One or more premixes may be used, and may include part or all of an ingredient.

The urea is of a particle size effective to combine with the cleaning agent and optional other ingredients to form a homogeneous mixture with a minimal amount of heat applied from an external source. The urea may be milled to a suitable particle size. Although a mill separate from the mixer may be used, an in-line mill can be used to provide continuous processing of the mixture. After processing, the mixture is discharged from the mixer, as for example, by pumping, pouring, casting or extruding. The composition is then allowed to harden to a solid form. Preferably, the processed composition "sets up" to a solid form within about 1 minute to about 3 hours, preferably about 5 minutes to about 1 hour, of being discharged from the mixer. Preferably, complete solidification or equilibrium of the processed composition is within about 1–48 hours of being discharged from the mixer, preferably within about 1–36 hours, preferably within about 1–24 hours. Solidification of the composition is substantially simultaneous throughout its mass, and without significant post-solidification swelling.

The term "solid" as used to describe the processed composition, means that a unit of the hardened composition with a mass of 50 to 500 grams will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition may range from that of a fused solid block which is a relatively dense and hard glossy or crystalline mass, for example, like concrete, to a consistency characterized as being malleable and sponge-like, similar to caulking material.

DETAILED DESCRIPTION OF THE INVENTION

The present invention provides a process for manufacturing a variety of solid alkaline cleaning compositions that comprise urea as a hardening or solidifying agent. Urea-based cleaning compositions that may be prepared according to the method of the invention include, for example, ware or hard surface cleaning compositions, sanitizing additives, deodorant blocks, and the like.

The compositions are produced using a batch or continuous mixing system, including a single- or twin-screw extruder, by combining and mixing a source of urea with one or more cleaning agents and optional other ingredients, such as a minor but effective amount of water. The processed mixture may be dispensed from the mixing system, by extruding, casting or other suitable means, whereupon the composition hardens to a solid form which ranges in consistency from a solid block to a malleable, spongy, self-supporting form such as a coil, square or other shape. Variations in processing parameters may be used to control the development of crystal size and crystalline structure of the matrix and thus the texture of the final product. The structure of the matrix may be characterized according to its hardness, melting paint, material distribution, crystal structure, and other like properties according to known methods in the art. A cleaning composition processed according to the method of the invention is substantially homogeneous with regard to the distribution of ingredients throughout its mass, and also substantially deformation-free.

Unless otherwise specified, the term "wt-%" is the weight of an ingredient based upon the total weight of the composition.

Urea Hardening Agent

The solidification rate of the compositions made according to the invention will vary, at least in part, according to the amount, and the particle size and shape of the urea added to the composition. In the method of the invention, a particulate form of urea is combined with an alkaline cleaning agent and optional other ingredients, preferably a minor but effective amount of water. The amount and particle size of the urea is effective to combine with the alkaline cleaning agent and other ingredients to form a homogeneous mixture. The urea will form a matrix with the cleaning agent and other ingredients which will hardens to a solid under ambient temperatures of about 30°–50° C., preferably about 35°–50° C., after the mixture is discharged from the mixing system, within about 2 minutes to about 3 hours, preferably about 5 minutes to about 2 hours, preferably about 10 minutes to about 1 hour. A minimal amount of heat from an external source may be applied to the mixture to facilitate processing of the mixture. The amount of urea included in the composition is effective to provide a cast solid material having surfaces that are stabilized to the effects of atmospheric humidity. The urea can also help provide a hardness and desired rate of solubility of the composition when placed in an aqueous medium to achieve a desired rate of dispensing the cleaning agent from the solidified composition during use. Preferably, the composition includes about 5–90 wt-% urea, preferably about 8–40 wt-%, preferably about 10–30 wt-%.

The urea may be in the form of prilled beads or powder. Prilled urea is generally available from commercial sources as a mixture of particle sizes ranging from about 8–15 U.S. mesh, as for example, from Arcadian Sohio Company, Nitrogen Chemicals Division. A prilled form of urea is preferably milled to reduce the particle size to about 50 U.S. mesh to about 125 U.S. mesh, preferably about 75–100 U.S. mesh, preferably using a wet mill such as a single or twin-screw extruder, a Teledyne mixer, a Ross emulsifier, and the like.

Active Ingredients

The present method is suitable for preparing a variety of solid cleaning compositions, as for example, detergent compositions, sanitizing compositions, conveyor lubricants, floor cleaners, deodorant blocks, and the like. The cleaning compositions of the invention comprise conventional alkaline cleaning agent and other active ingredients that will vary according to the type of composition being manufactured.

A urea-based alkaline detergent composition can include a source of alkalinity and minor but effective amounts of other ingredients such as a chelating agent/sequestrant such as ethylenediaminetetraacetic acid (EDTA) or sodium tripolyphosphate, a bleaching agent such as sodium hypochlorite or hydrogen peroxide, an enzyme such as a protease or an amylase, and the like.

Alkaline Sources

The cleaning composition produced according to the invention may include minor but effective amounts of one or more alkaline sources to enhance cleaning of a substrate and improve soil removal performance of the composition. The caustic matrix has a tendency to solidify due to the activity of an alkaline source in fixing the free water present in a composition as water of hydration. Premature hardening of the composition may interfere with mixing of the active ingredients with the urea hardening agent to form a homogeneous mixture, and/or with casting or extrusion of the processed composition. Accordingly, an alkali metal hydroxide or other alkaline source is preferably included in the cleaning composition in an amount effective to provide the desired level of cleaning action yet avoid premature solidification of the composition by the reaction of the caustic material with the other ingredients. However, it can be appreciated that an alkali metal hydroxide or other hydratable alkaline source can assist to a limited extent, in solidification of the composition. It is preferred that the composition comprises about 0.1–70 wt-%, preferably about 5–60 wt-% of an alkaline source, most preferably about 10–50 wt-%.

Suitable alkali metal hydroxides include, for example, sodium or potassium hydroxide. An alkali metal hydroxide may be added to the composition in the form of solid beads, dissolved in an aqueous solution, or a combination thereof. Alkali metal hydroxides are commercially available as a solid in the form of prilled beads having a mix of particle sizes ranging from about 12–100 U.S. mesh, or as an aqueous solution, as for example, as a 50 wt-% and a 73 wt-% solution. It is preferred that the alkali metal hydroxide is added in the form of an aqueous solution, preferably a 50 wt-% hydroxide solution, to reduce the amount of heat generated in the composition due to hydration of the solid alkali material. The cleaning composition may comprise an alkaline source other than an alkali metal hydroxide. Examples of useful alkaline sources include a metal silicate such as sodium or potassium silicate (with a $M_2O:SiO_2$ ratio of 1:1 to 5:1, M representing an alkali metal) or metasilicate, a metal carbonate such as sodium or potassium carbonate, bicarbonate, sesquicarbonate, and the like; a metal borate such as sodium or potassium borate, and the like; ethanolamines and amines; and other like alkaline sources. Secondary alkalinity agents are commonly available in either aqueous or powdered form, either of which is useful in formulating the present cleaning compositions. The composition may include a secondary alkaline source in an amount of about 1–30 wt-%, preferably about 10–20 wt-%.

Cleaning Agents

The composition can comprises at least one cleaning agent which is preferably a surfactant or surfactant system. A variety of surfactants can be used in a cleaning composition, including anionic, cationic, nonionic and zwitterionic surfactants, which are commercially available from a number of sources. For a discussion of surfactants, see Kirk-Othmer, *Encyclopedia of Chemical Technology*, Third Edition, volume 8, pages 900–912. Preferably, the cleaning composition comprises a cleaning agent in an amount effective to provide a desired level of cleaning, preferably about 30–95 wt-%, more preferably about 50–85 wt-%.

Anionic surfactants useful in the present urea-based cleaning compositions, include, for example, carboxylates such as alkylcarboxylates and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are sodium alkylarylsulfonate, alpha-olefinsulfonate, and fatty alcohol sulfates.

Nonionic surfactants useful in cleaning compositions, include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine;

alcohol alkoxylates such as alcohol ethyoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC™ (BASF-Wyandotte), and the like; and other like nonionic compounds.

Cationic surfactants useful for inclusion in a cleaning composition for sanitizing or fabric softening, include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-l-(2-hydroxyethyl)-2-imidazoline, and the like; and quaternary ammonium salts, as for example, alkylquaternary ammonium chloride surfactants such as n-alkyl($C_{12}$–$C_{18}$)dimethylbenzyl ammonium chloride, n-tetradecyldimethylbenzylammonium chloride monohydrate, a naphthylene-substituted quaternary ammonium chloride such as dimethyl-1-naphthylmethylammonium chloride, and the like; and other like cationic surfactants.

Also useful are zwitterionic surfactants such as β-N-alkylaminopropionic acids, N-Alkyl-β-iminodipropionic acids, imidazoline carboxylates, N-alkylbetaines, sultaines, and the like.

Other Additives

Urea-based compositions made according to the invention may further include conventional additives such as a chelating/sequestering agent, bleaching agent, alkaline source, secondary hardening agent or solubility modifier, detergent filler, defoamer, anti-redeposition agent, a threshold agent or system, aesthetic enhancing agent (i.e., dye, perfume), and the like. Adjuvants and other additive ingredients will vary according to the type of composition being manufactured. The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. Preferably, a cleaning composition includes about 0.1–70 wt-%, preferably from about 5–50 wt-%, of a chelating/sequestering agent.

Useful aminocarboxylic acids include, for example, n-hydroxyethyliminodiacetic acid, nitrilotriacetic acid (NTA), ethylenediaminetetraacetic acid (EDTA), N-hydroxyethylethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as aminotris(methylene phosphonic acid), hydroxyethylidene diphosphonic acid, ethylenediaminetetrae(methylene phosphonic acid), diethylenetriaminepente(methylene phosphonic acid), and the like. It is preferred to use a neutralized or alkaline phosphonate, or to combine the phosphonate with an alkali source prior to being added into the mixture such that there is little or no heat generated by a neutralization reaction when the phosphate is added.

Polyacrylates suitable for use as cleaning agents include, for example, polyacrylic acid, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, *Encyclopedia of Chemical Technology*, Third Edition, volume 5, pages 339–366 and volume 23, pages 319–320, the disclosure of which is incorporated by reference herein.

Bleaching agents for use in a cleaning compositions for lightening or whitening a substrate, include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the present cleaning compositions include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorides, monochloramine and dichloramine, and the like. Encapsulated chlorine sources may also be used to enhance the stability of the chlorine source in the composition (see, for example, U.S. Pat. No. 4,618,914, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, preferably about 0.1–10 wt-%, preferably about 1–6 wt-%.

Secondary Hardening Agents/Solubility Modifiers. The present compositions may include a minor but effective amount of a secondary hardening agent, as for example, an amide such stearic monoethanolamide or lauric diethanolamide, or an alkylamide, and the like; a solid polyethylene glycol or a propylene glycol, and the like; starches that have been made water-soluble through an acid or alkaline treatment process; various inorganics that impart solidifying properties to a heated composition upon cooling, and the like. Such compounds may also vary the solubility of the composition in an aqueous medium during use such that the cleaning agent and/or other active ingredients may be dispensed from the solid composition over an extended period of time. The composition may include a secondary hardening agent in an amount of about 5–20 wt-%, preferably about 10–15 wt-%.

Detergent Fillers. A cleaning composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, $C_1$–$C_{10}$ alkylene glycols such as propylene glycol, and the like. Preferably, a detergent filler is included in an amount of about 1–20 wt-%, preferably about 3–15 wt-%.

Defoaming Agents. A minor but effective amount of a defoaming agent for reducing the stability of foam may also be included in the present urea-based cleaning compositions. Preferably, the cleaning composition includes about 0.0001–5 wt-% of a defoaming agent, preferably about 0.01–1 wt-%.

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-redeposition Agents. A cleaning composition may also include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. A cleaning composition may include about 0.5–10 wt-%, preferably about 1–5 wt-%, of an anti-redeposition agent.

Dyes/Odorants. Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Aqueous Medium

The ingredients may optionally be processed in a minor but effective amount of an aqueous medium such as water to solubilize the urea and other ingredients and achieve a homogenous mixture, to aid in the urea occlusion reaction, to provide an effective level of viscosity for processing the mixture, and to provide the processed composition with the desired amount of firmness and cohesion during discharge and upon hardening. It is preferred that the mixture during processing comprises about 2–15 wt-% of an aqueous medium, preferably about 3–5 wt-%. Preferably, the ratio of water to urea in the mixture is about 0.5:3 to about 1:6, preferably about 1:3 to about 1:5, preferably about 1:4. Preferably, the composition upon being discharged from the mixture includes about 2–5 wt-% water, preferably about 3–5 wt-%.

Processing of the Composition

The invention provides a method of processing a urea-based cleaning composition. According to the invention, a cleaning agent and optional other ingredients are mixed with an effective solidifying amount of urea in an aqueous medium. A minimal amount of heat may be applied from an external source to facilitate processing of the mixture.

The urea based alkaline cast solid materials of the invention can be manufactured in batch processing. In such processing, one or more of the ingredients used in making the cast solid materials can be charged to a mixing vessel that can be equipped with a heating source such as hot water, steam, electrical heaters, etc. The container and its charge can be heated to an effective mixing temperature and the balance of ingredients can be added included urea or other components. Once fully uniformed, the agitated contents can then be removed from the batch mixer into molds or containers for solidification. Alternatively, the mixing of the ingredients can be accomplished in a series of two or more batch mixing vessels, each equipped with its own agitator and heat source. Ingredients can be added singly to any specific mixing apparatus or can be combined to make a premix which can be charged to a mixing apparatus prior to the addition of other ingredients or can be added to one or more ingredients in mixing apparatus.

Optional mixing system provides for continuous mixing of the ingredients at high shear to form a substantially homogeneous liquid or semi-solid mixture in which the ingredients are distributed throughout its mass. Preferably, the mixing system includes means for mixing the ingredients to provide shear effective for maintaining the mixture at a flowable consistency, with a viscosity during processing of about 1,000–1,000,000 cps, preferably about 5,000–200,000 cps. The mixing system is preferably a continuous flow mixer, as for example, a Teledyne continuous processor or a Breadsley Piper continuous mixer, more preferably a single or twin screw extruder apparatus, with a twin-screw extruder being highly preferred, as for example, a multiple section Buhler Miag twin screw extruder.

It is preferred that the mixture is processed at a temperature to maintain stability of the ingredients, preferably at ambient temperatures of about 30°–80° C., more preferably about 35°–50° C. Although limited external heat may be applied to the mixture, it can be appreciated that the temperature achieved by the mixture may become elevated during processing due to variances in ambient conditions, and/or by an exothermic reaction between ingredients. Optionally, the temperature of the mixture may be increased, for example, at the inlets or outlets of the mixing system, by applying heat from an external source to achieve a temperature of about 50°–150° C., preferably about 55°–70° C., to facilitate processing of the mixture.

Optionally, the mixing system can include means for milling the urea, such as a prilled urea, to a desired particle size. The urea may be milled separately prior to being added to the mixture, or with another ingredient. Preferably, the urea is wet milled by means of an in-line wet mill, as for example, a twin-screw extruder, a Teledyne mixer, a Ross emulsifier, and the like. Preferably, the urea is milled to a particle size effective for the urea to combine with the cleaning agent and optional other ingredients to form a homogeneous mixture without heat applied from an external source. Preferably, the particle size of the urea in the mixture is about 50–125 U.S. mesh, more preferably about 75–100 U.S. mesh.

An ingredient may be in the form of a liquid or a solid such as a dry particulate, and may be added to the mixture separately or as part of a premix with another ingredient, as for example, the cleaning agent, the urea, the aqueous medium, and additional ingredients such as a second cleaning agent, a detergent adjuvant or other additive, a secondary hardening agent, and the like. One or more premixes may be added to the mixture.

An aqueous medium may be included in the mixture in a minor but effective amount to solubilize the urea, to maintain the mixture at a desired viscosity during processing, and to provide the processed composition and final product with a desired amount of firmness and cohesion. The aqueous medium may be included in the mixture as a separate ingredient, or as part of a liquid ingredient or premix.

The ingredients are mixed to form a substantially homogeneous consistency wherein the ingredients are distributed substantially evenly throughout the mass. The mixture is then discharged from the mixing system by casting into a mold or other container, by extruding the mixture, and the like. Preferably, the mixture is cast or extruded into a mold or other packaging system which can optionally, but preferably, be used as a dispenser for the composition. It is preferred that the temperature of the mixture when discharged from the mixing system is sufficiently low to enable the mixture to be cast or extruded directly into a packaging system without first cooling the mixture. Preferably, the mixture at the point of discharge is at about ambient temperature, about 30°–50° C., preferably about 35°–45° C. The composition is then allowed to harden to a solid form that may range from a low density, sponge-like, malleable, caulky consistency to a high density, fused solid, concrete-like block.

Optionally, heating and cooling devices may be mounted adjacent to mixing apparatus to apply or remove heat in order to obtain a desired temperature profile in the mixer. For example, an external source of heat may be applied to one or more barrel sections of the mixer, such as the ingredient inlet section, the final outlet section, and the like, to increase fluidity of the mixture during processing. Preferably, the temperature of the mixture during processing, including at the discharge port, is maintained at or below the melting temperature of the urea and other ingredients, preferably at about 20°–150° C.

When processing of the ingredients is completed, the mixture may be discharged from the mixer through a discharge port. The cast composition eventually hardens due, at least in part, to cooling and/or the chemical reaction of the ingredients. The solidification process may last from a few minutes to about 2–3 hours, depending, for example, on the size of the cast or extruded composition, the ingredients of the composition, the temperature of the composition, and other like factors. Preferably, the cast or extruded composition "sets up" or begins to hardens to a solid form within about 1 minute to about 3 hours, preferably about 2 minutes to about 2 hours, preferably about 5 minutes to about 1 hour.

Packaging System

The processed compositions of the invention may be cast into temporary molds from which the solidified compositions may be removed and transferred for packaging. The compositions may also be cast directly into a packaging receptacle. Extruded material may also be cut to a desired size and packaged, or stored and packaged at a later time.

The packaging receptacle or container may be rigid or flexible, and composed of any material suitable for containing the compositions produced according to the invention, as for example, glass, steel, plastic, cardboard, cardboard composites, paper, and the like.

Advantageously, since the composition is processed at or near ambient temperatures, the temperature of the processed mixture is low enough so that the mixture may be cast or extruded directly into the container or other packaging receptacle without structurally damaging the receptacle material. As a result, a wider variety of materials may be used to manufacture the container than those used for compositions that processed and dispensed under molten conditions.

Preferred packaging used to contain the compositions is manufactured from a material which is biodegradable and/or water-soluble during use. Such packaging is useful for providing controlled release and dispensing of the contained cleaning composition. Biodegradable materials useful for packaging the compositions of the invention include, for example, water-soluble polymeric films comprising polyvinyl alcohol, as disclosed for example in U.S. Pat. No. 4,474,976 to Yang; U.S. Pat. No. 4,692,494 to Sonenstein; U.S. Pat. No. 4,608,187 to Chang; U.S. Pat. No. 4,416,793 to Haq; U.S. Pat. No. 4,348,293 to Clarke; U.S. Pat. No. 4,289,815 to Lee; and U.S. Pat. No. 3,695,989 to Albert, the disclosures of which are incorporated by reference herein.

Where the composition comprises a highly caustic material, safety measures should be taken during manufacture, storage, dispensing and packaging of the processed composition. In particular, steps should be taken to reduce the risk of direct contact between the operator and the solid cast composition, and the washing solution that comprises the composition.

Dispensing of the Processed Compositions

The cleaning composition made according to the present invention is dispensed from a spray-type dispenser such as that disclosed in U.S. Pat. Nos. 4,826,661, 4,690,305, 4,687,121, and 4,426,362, the disclosures of which are incorporated by reference herein. Briefly, a spray-type dispenser functions by impinging a water spray upon an exposed surface of the solid composition to dissolve a portion of the composition, and then immediately directing the concentrate solution comprising the composition out of the dispenser to a storage reservoir or directly to a point of use.

The invention will be further described by reference to the following detailed examples. These examples are not meant to limit the scope of the invention that has been set forth in the foregoing description. Variation within the concepts of the invention are apparent to those skilled in the art.

EXAMPLE 1

A detergent composition was prepared for use in hard surface cleaning. The ingredients were combined into a tekumar mixer, heated to 105°–110° F. and blended for seven minutes up to 110° F. After uniformity, the urea was added. Blended was continued until uniformity and the material was removed from the mixer and cast and solidified in plastic containers that weigh approximately 8 pounds. Ingredients of the composition are as follows:

| ITEM | PERCENT | WEIGHT |
|---|---|---|
| HF-055 ($C_{10-14}$ Alcohol 12–15 mole Ethoxylate) | 26.000 | 39.00 (lbs.) |
| NPE 9.5 (Nonyl Phenol 9.5 Ethoxylate) | 2.909 | 4.36 |
| NPE 6.5 (Nonyl Phenol 6.5 Ethoxylate) | 1.091 | 1.64 |
| UREA | 17.481 | 26.22 |
| DYE | 0.060 | 40.9 (Grams) |
| DYE | 0.015 | 10.2 (Grams) |
| ANTIFOAM 544 (Silicone Defoamer) | 0.009 | 6.1 (Grams) |
| NACAP (Sodium Mercapto-benzothiazol 50% Active) | 1.000 | 1.5 (lbs.) |
| MONOETHANOL AMINE | 40.000 | 60.00 |
| NaEDTA | 5.860 | 8.79 |
| FRAGRANCE | 0.500 | 0.75 |
| WATER | 5.075 | 7.61 |

| ITEM | PERCENT | WEIGHT |
|---|---|---|
| NPE 9.5 (Nonyl Phenol 9.5 Ethoxylate) | 9.136 | 4.57 (lbs.) |
| NPE 6.5 (Nonyl Phenol 6.5 Ethoxylate) | 3.364 | 1.68 |
| UREA | 22.892 | 11.45 |
| HF-055 ($C_{10-14}$ Alcohol 12–15 mole Ethoxylate) | 22.000 | 11.00 |
| MONOETHANOL AMINE | 32.000 | 16.00 |
| FRAGRANCE | 0.200 | 45 (Grams) |
| DYE | 0.060 | 13 (Grams) |
| WATER | 5.048 | 2.52 (lbs.) |
| BUTYL CELLUSOLVE | 5.500 | 2.75 |

| RAW MATERIALS | PERCENT | TOTAL LBS. |
|---|---|---|
| UREA | 27.000 | 21.600 |
| SOFT WATER | 9.800 | 7.840 |
| NAS-8D SPRAY DRIED (n-octane Sulfonate) | 0.250 | 0.200 |
| DIRECT BLUE 86 | 0.060 | 0.048 |
| CITRUS FRAGRANCE | 0.210 | 0.168 |
| NPE 9.5 (Nonyl Phenol 9.5 Ethoxylate) | 3.000 | 2.400 |
| LAS-90F (Linear Lauryl Alkane Sulfonate) | 4.000 | 3.200 |
| ADMOS 1485 ($C_{10-14}$ Alkyl Amine Oxide) | 3.500 | 2.800 |
| SODIUM TRIPOLYPHOS-PHATE | 24.180 | 19.344 |
| SODIUM CARBONATE | 28.000 | 22.400 |

| RAW MATERIAL | WT-% | 2500 GRAM BATCH |
|---|---|---|
| UREA | 22.00 | 550.00 |
| SOFT WATER | 5.48 | 137.00 |
| PEG 1450 (Polyethylene Glycol M.W. 1450) | 10.00 | 250.00 |
| NAS 8D (n-octane Sulfonate) | 0.25 | 6.25 |
| LAS 90 F (Linear Lauryl Alkane Sulfonate) | 5.00 | 125.00 |
| ADMOX 1485 ($C_{10-14}$ Alkyl Amine Oxide) | 5.00 | 125.00 |
| HEXYLENE GLYCOL | 3.00 | 75.00 |
| DYE | 0.06 | 1.50 |
| FRAGRANCE | 0.21 | 5.25 |
| STPP (Sodium Tripoly-phosphate) | 22.00 | 550.00 |
| $Na_2CO_3$ | 27.00 | 675.00 |
| | 100.00 | 2500.00 |

The sodium carbonate based cleaning material of Example 4 was tested for environmental stability by exposing the cast material to conditions of high temperature and high humidity (100° F. and 100 relative humidity). The response of the cast material to absorbing atmospheric water was noted. The results of the change in weight of the material is shown in Table I which presents the percent of the original weight of the material as it changes over time.

TABLE I

| | % OF ORIGINAL WEIGHT WEEPING TEST | |
|---|---|---|
| TIME (HRS.) | EXAMPLE 3 | PRODUCT WITH NO UREA |
| 0 | 100 | 100 |
| 20 | 109 | 82 |
| 40 | 110 | 71 |
| 65 | 109 | 66 |
| 80 | 108 | 65 |
| 140 | 102 | 60 |

The Table clearly shows that the urea based material is substantially more stable to the conditions of temperature and humidity when compared to a similar material made without urea. The urea free material shows that the material absorbs substantial quantities of water resulting in the flow of a thick concentrated solution of the material from the cast solid resulting in a substantial loss of mass due to humidity absorption. While the urea material absorbed water from the air as shown in the increasing weight over time, the material remained a substantially intact material having substantial surface integrity.

In further comparisons between a solid cleaning composition such as in Example 3 and a similar product using no urea, the urea containing product was equivalent to or superior to the non-urea containing formulations in soil removal and dispensing properties. The materials of the invention were shown to dispense from water spray dispensers in a controllable cost effective manner.

We claim:

1. A uniform alkaline cast solid composition that is chemically and dimensionally stable, which composition comprises:

(a) at least 5 wt-% of an alkaline cleaning composition comprising an alkali metal hydroxide, an alkali metal silicate, an alkali metal carbonate or a strong organic base;

(b) an effective cleaning or sequestering amount of a chemical composition selected from the group consisting of a detergent builder or a sequestrant;

(c) about 0.1 to 70 wt-% of a urea compound casting agent; and (d) about 1 to 20 wt-% of water of hydration wherein the water of hydration is associated with one or more of the solid components of (a) (b) or (c); wherein the composition is solidified in a packaging receptacle.

2. The composition of claim 1 which additionally comprises an effective amount of an encapsulated source of a halogen bleach.

3. The composition of claim 1 wherein the cast composition is greater than about 0.5 Kg.

4. The composition of claim 1 which additionally comprises an effective detergent amount of an organic surfactant.

5. The composition of claim 1 wherein the sequestrant is an organic sequestrant.

6. The composition of claim 1 wherein the source of alkalinity comprises sodium hydroxide.

7. The composition of claim 1 wherein the source of alkalinity comprises sodium carbonate.

8. The composition of claim 1 wherein the source of alkalinity comprises a sodium silicate having a $Na_2O:SiO_2$ ratio of greater than about one part of $Na_2O$ per each part of $SiO_2$.

9. The composition of claim 1 wherein the source of alkalinity comprises an amine selected from the group consisting of monoethanol amine, diethanol amine, triethanol amine and mixtures thereof.

* * * * *